United States Patent [19]

Villard

[11] Patent Number: 4,907,361

[45] Date of Patent: Mar. 13, 1990

[54] LUMINOUS PANEL FOR ADVERTISING ON THE GROUND

[76] Inventor: Jean-Pierre Villard, 19 Rue Phillippe Gonnard, Lyon, France, 69001

[21] Appl. No.: 153,048

[22] Filed: Feb. 8, 1988

[30] Foreign Application Priority Data

Feb. 18, 1987 [FR] France ..... 87 02432

[51] Int. Cl.[4] ..... G09F 13/04

[52] U.S. Cl. ..... 40/565; 40/612; 362/153; 362/153.1; 362/367

[58] Field of Search ..... 40/565, 612; 362/153, 362/367, 153.1

[56] References Cited

U.S. PATENT DOCUMENTS 640,140 12/1899 Lloyd ..... 40/565
4,329,739 5/1982 Loebner ..... 362/153

FOREIGN PATENT DOCUMENTS 612265 8/1926 France ..... 40/565
558442 3/1957 Italy ..... 40/565
145911 6/1931 Switzerland ..... 362/153
26154 of 1912 United Kingdom ..... 40/565
2040534 8/1980 United Kingdom ..... 40/565

*Primary Examiner*—Kenneth J. Dorner
*Assistant Examiner*—J. Hakomaki
*Attorney, Agent, or Firm*—Dowell & Dowell

[57] ABSTRACT

An illuminated display device for installation in the ground or surface of a pavement and which incorporates a concrete base which houses a light source and which further supports a first fixed frame to which is mounted a thick transparent plate which plate is reinforced by transparent support members which extend upwardly from the bottom of the concrete base and which further includes an articulated thinner transparent plate which is mounted to a moveable frame which is secured over the fixed transparent plate in such a manner that advertising displays may be placed intermediate the two plates with the plates being selectively locked to retain the advertising displays therebetween.

13 Claims, 3 Drawing Sheets

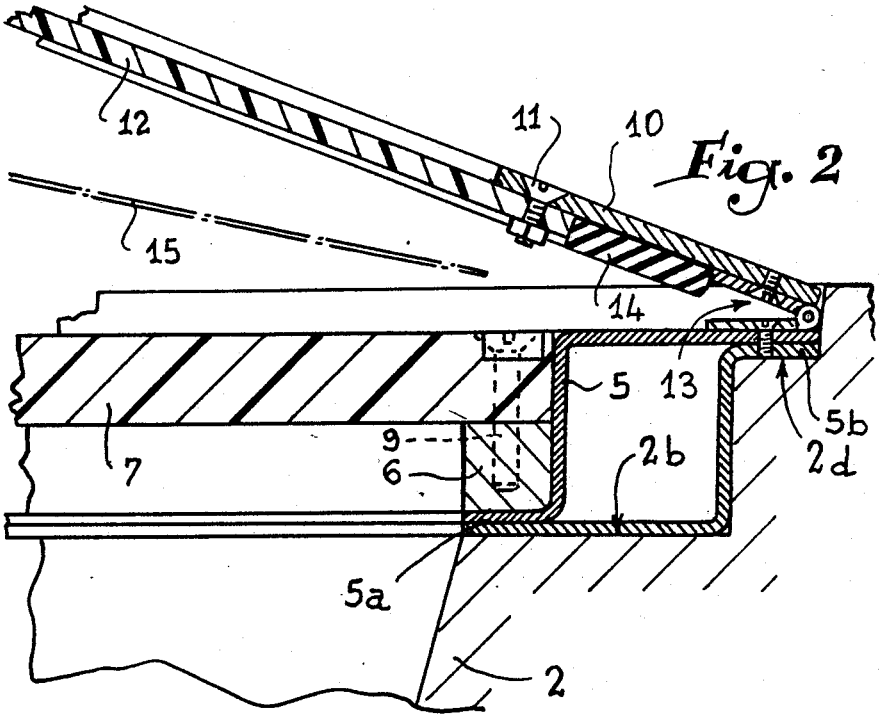
Fig. 2
Fig. 3
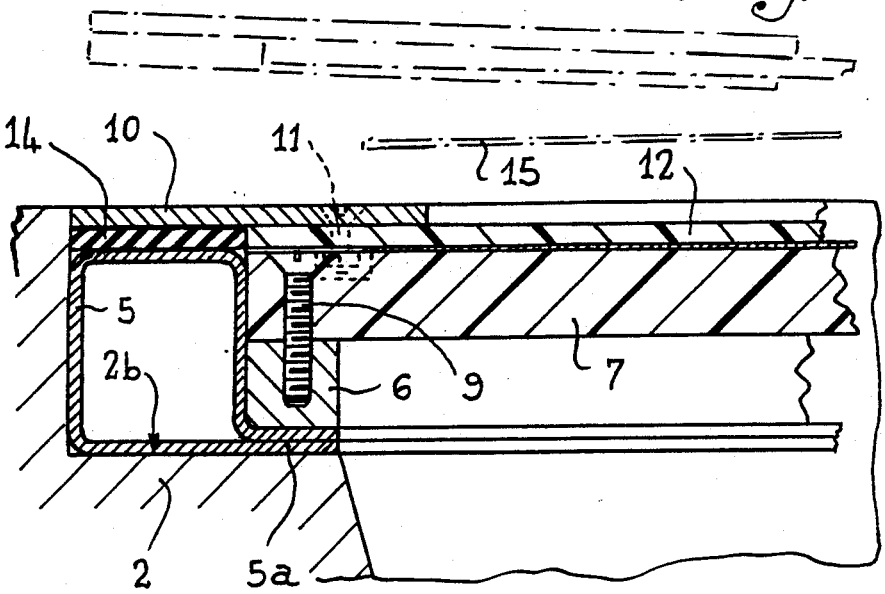

LUMINOUS PANEL FOR ADVERTISING ON THE GROUND

BACKGROUND OF THE INVENTION

History of the Related Art

It is known that luminous panels have already been proposed which are intended to be sealed in the ground at the level of the pavements of public highways or the roads of pedestrian precincts, to provide lighting and evidencing of advertizing posters or other similar printed documents. However, these attempts has not been successful due to the low resistance of the boxes to the load to which they are subjected either from the delivery lorries which serve the pedestrian precincts or by cleaning or security vehicles.

SUMMARY OF THE INVENTION

It is an object of the present invention to overcome this drawback by producing a luminous advertizing box which, by its structural integrity, is capable of resisting, without failure the highest rolling loads.

The advertising box according to the invention comprises a base of reinforced concrete or fiber concrete, intended to be sealed in an excavation made in the ground and which are equipped with a light source formed by a series of electrical tubes oriented parallel to one another. This base presents, slightly below its open upper edge, a peripheral shoulder or step against which abuts a metal frame forming support for a fixed transparent plate of considerable thickness, made for example of methacrylate or other similar transparent resin; this plate also abuts against a series of parallel distance pieces which rest against the bottom of the base and which are themselves made of a transparent synthetic material This assembly is completed by an opening frame which is articulated along one of the edges of the fixed frame and which carries a transparent protecting plate. The poster to be exhibited is thus capable of being maintained between the two transparent plates of the box while being illuminated from beneath. A closure mechanism, advantageously formed by a series of individual locks, ensures locking of the opening frame on the fixed frame and allows replacement of the poster when desired.

BRIEF DESCRIPTION OF THE DRAWINGS

The accompanying drawing, given by way of example, will enable the invention, the characteristics that it presents and the advantages that it is capable of procuring, to be more readily understood:

FIGS. 2 and 3 are transverse sections in detail showing two opposite sides of the fixed and opening frames of the box according to FIG. 1.

DESCRIPTION OF THE PREFERRED EMBODIMENT

Figure 1:
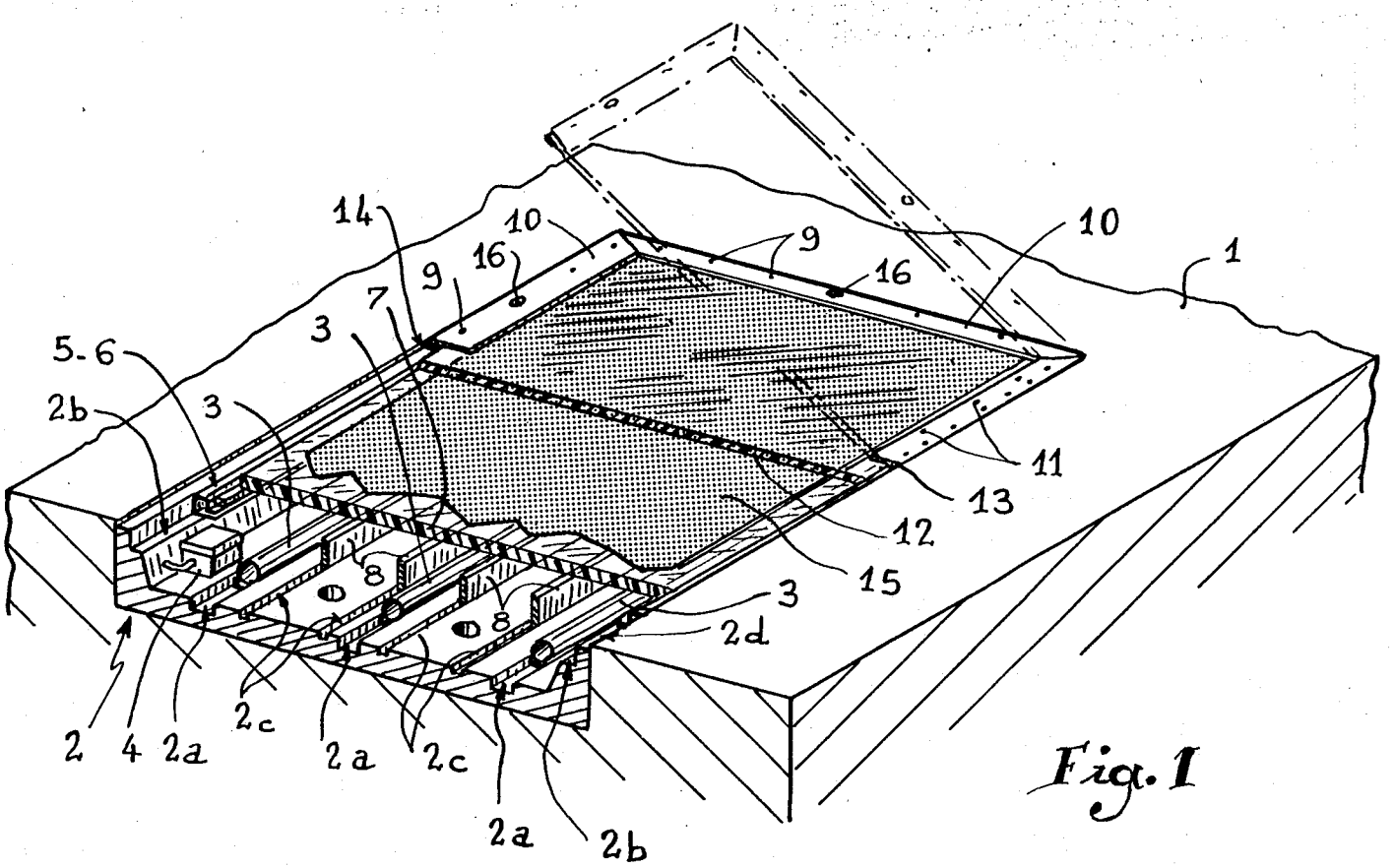
FIG. 1 is a section illustrating the general arrangement and the implantation of a luminous box according to the invention.

In FIG. 1, reference 1 designates a road in which has been an excavation for sealing a concrete base 2 of rectangular profile, the open upper edge of the upper edges of the side walls of the base being disposed substantially at the level of the road 1. The bottom of this base 2 includes longitudinal housings or channels 2a in which are fixed the supports of a series of electrical lighting tubes 3 which are enegized through a junction box 4.

Below its upper free edge, the base 2 comprises a peripheral step 2b which is arranged to support the fixed frame of the box. This fixed frame is formed by four square-sectioned elements 5 provided with a lower lateral flange 5a which supports square-sectioned strips 6. On these strips 6 abuts the edge of a transparent plate or slab 7 of considerable thickness, advantageously made of a resin of the methacrylate type. It will be observed that, with a view to further reinforcing the resistance of plate 7, a series of vertical support plates 8 have been provided (cf. FIG. 1) of which the lower edge is engaged in a groove 2c made in the base 2 between the housings 2a thereof: these supports 8 are preferably made of methacrylate so as not to hinder diffusion of the light emitted by tubes 3.

In order to avoid any untimely displacement of the plate 7 with respect to the fixed frame 5-6 which supports it, a series of screws 9 have been provided, which pass through the plate to cooperate with tappings made in the strips 6, as illustrated in FIG. 3.

With the fixed frame 5-6 is associated an opening frame formed by the assembly of four elements 10 of flat profile which is secured, for example, with the aid of screws such as 11, with a transparent plate 12, likewise made of resin, but made with a thickness less than that of the plate 7. This opening frame 10-12 is assembled on the fixed frame 5-6 by means of a flat hinge 13 (FIG. 2) which extends along one of the longitudinal sides of the box. One of the elements of this hinge 13 is fixed to the corresponding element 10, while the other is secured with an upper flange 5b provided on the section 5 shown the flange resting on a step 2*d* on the corresponding side of the base 2.

In order to avoid any introduction of water inside the base 2, the opening frame 10-12 is equipped with an 0-ring or seal 14 adapted to abut against the upper face of the profiles 5 of the fixed frame 5-6. In this way is avoided any risk of damaging a poster 15 intended to be inserted, by opening the opening frame, between the plate 12 of the frame and the thick plate 7. The poster 15, while maintained flat, is illuminated by the luminous tubes 3 and consequently appears through the upper plate 12.

Figure 4:
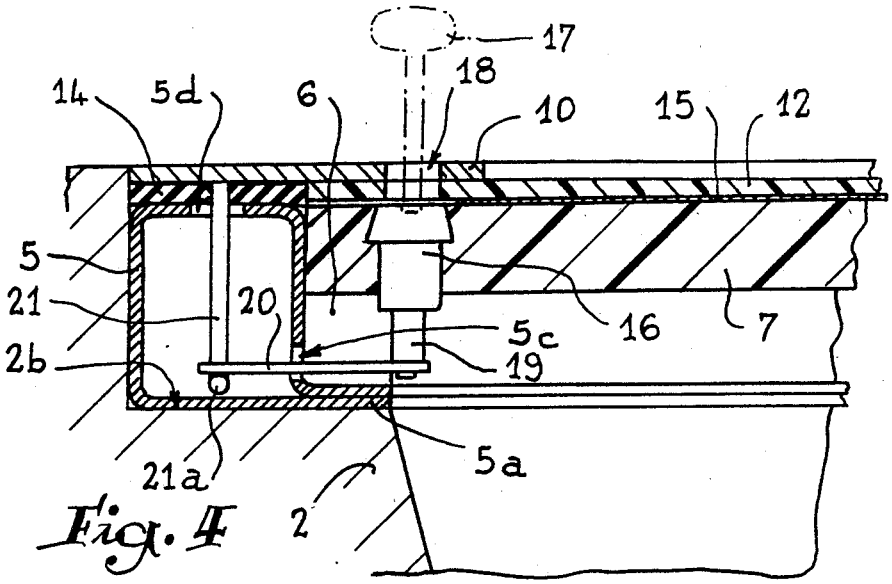
FIGS. 4 and 5 show, in closed position and in open position, one of the lock mechanisms ensuring locking of the opening frame.
Figure 5:
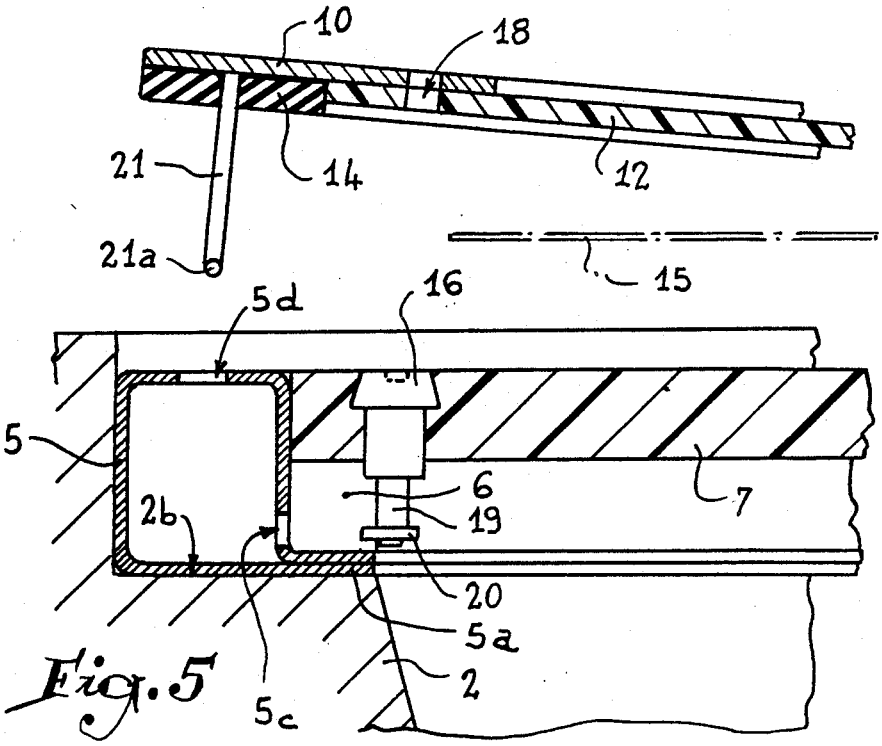

With a view to avoiding opening of the opening frame by non-entitled persons, a closure mechanism is provided formed by a series of individual locks of which the body 16 (FIG. 4) is crimped in the thickness of the plate 8. Each lock is manoeuvred with the aid of a removable key 17 introduced through a slot 18 made in the opening frame 10-12. The rotating shank 19 of each lock 16 includes a bolt 20 disposed in the free space made between the two adjacent strips 6, so as to penetrate in the element 5 through an opening 5*c* engages a flange 21*a* of a finger 21 which is secured with the opening frame 10-12, which finger penetrates in the frame element 5 through an upper slot 5*d* (cf. FIG. 5).

The construction of the assembly of the box described hereinabove is very simple and economical. Tests have shown that such a box presented a very high resistance to loads, which protected it from any damage caused by lorries or other heavy vehicles rolling thereon. It goes without saying that the box may present in plan any desired profile.

It must, moreover, be understood that the foregoing description has been given only by way of example and that it in no way limits the domain of the invention which would not be exceeded by replacing the details of execution described by any other equivalents.

I claim:

1. An illuminated display device for installation in an opening in a pavement surface comprising a base portion situated within the opening and having a bottom and side walls, said side walls extending upwardly so that the upper edges thereof will be adjacent to the level of the pavement, an inwardly extending peripheral step formed along said side walls and spaced below said upper edges thereof, an electrical light source mounted within said base portion, a fixed frame supported on said peripheral step, a first transparent plate supported on said fixed frame so as to substantially cover the opening, at least one elongated transparent support means disposed within said base portion and extending vertically between said bottom and said first transparent plate intermediate said side walls thereof, means for securing said support means to said bottom, a second frame, means for moveably securing said second frame to said fixed frame, a second transparent plate carried by said second frame, and closure means for selectively securing said second frame to said fixed frame whereby a display may be selectively mounted between said first and second transparent plates and illuminated by said light source.

2. The advertising display device of claim 1 including a plurality of light sources disposed within said base portion, and a plurality of support means disposed in spaced relationship within said base portion and intermediate said light sources.

3. The illuminated display device of claim 2 in which said first transparent plate is of a first thickness and said second transparent plate is of a second thickness said first thickness being greater than said second thickness.

4. The illuminated display device of claim 3 in which each of said first and second transparent plates and said transparent supports are formed of a synthetic transparent plastic.

5. The illuminated display device of claim 4 in which said means for securing said support means to said bottom of said base portion includes a plurality of elongated channels formed in said bottom of said base portion, each of said support means being receivable within one of said channels so as to be in spaced relationship with respect to one another.

6. The illuminated display device of claim 1 in which said fixed frame includes an inwardly extending lower lateral flange, strip means supported on said lateral flange, said first transparent plate being supported on said strip means and means for securing said first transparent plate to said strip means.

7. The illuminated display device of claim 6 in which a portion of said fixed frame includes an upper outwardly extending lateral flange, and said means for moveably securing said second frame to said fixed frame includes a hinge means connected both to said outwardly extending lateral flange and to said second frame.

8. The illuminated display device of claim 7 including a seal means disposed between said fixed frame and said second frame.

9. The illuminated display device of claim 8 in which said closure means for selectively securing said second frame to said fixed frame includes at least one elongated finger element carried by said second frame and extending downwardly within said fixed frame, at least one lock disposed through aligned openings provided in said first and second transparent plates, said lock having a bolt portion extending outwardly therefrom, said bolt portion being selectively maneuvered so as to cooperate with said finger element to prevent said finger element from being withdrawn from within said fixed frame to thereby secure said second frame to said fixed frame.

10. The illuminated display device of claim 1 in which said closure means for selectively securing said second frame to said fixed frame includes at least one elongated finger element carried by said second frame and extending downwardly within said fixed frame, at least one lock disposed through aligned openings provided in said first and second transparent plates, said lock having a bolt portion extending outwardly therefrom, said bolt portion being selectively maneuvered so as to cooperate with said finger element to prevent said finger element from being withdrawn from within said fixed frame to thereby secure said second frame to said fixed frame.

11. An illuminated display device for installation in an opening in a pavement surface comprising a base portion situated within the opening and having a bottom and side walls, said side walls extending upwardly so that the upper edges thereof will be adjacent to the level of the pavement, an inwardly extending peripheral step formed along said side walls in spaced below said upper edges thereof, a plurality of electrical light sources mounted within said base portion, a fixed frame supported on said fixed frame so as to substantially cover the opening, a plurality of elongated transparent support means disposed within said base portion and extending vertically between said bottom and said first transparent plate intermediate said light sources, means for securing said support means to said bottom, a second frame, means for moveably securing said second frame to said fixed frame, a second transparent plate carried by said second frame, said first transparent plate being of a first thickness and said second transparent plate being of a second thickness, said first thickness being greater than said second thickness, each of said first and second transparent plates and said transparent supports being formed of a synthetic transparent plactic, and closure means for selectively securing said second frame to said fixed frame whereby a display may be selectively mounted between said first and second transparent plates and illuminated by said light sources.

12. The illuminated display device of claim 11 in which said fixed frame includes an inwardly extending lower lateral flange, strip means supported on said lateral flange, said first transparent plate being supported on said strip means and means for securing said first transparent plate to said strip means, a portion of said fixed frame includes an upper outwardly extending lateral flange, said means for moveably securing said second frame to said fixed frame includes a hinge means connected both to said outwardly extending lateral flange and to said second frame, and a seal means disposed between said fixed frame and said second frame.

13. The illuminated display device of claim 12 in which said closure means for selectively securing said second frame to said fixed frame includes at least one elongated finger element carried by said second frame and extending downwardly within said fixed frame, at least one lock disposed through aligned openings provided in said first and second transparent plates, said lock having a bolt portion being selectively maneuvered so as to cooperate with said finger element to prevent said finger element from being withdrawn from within said fixed frame to thereby secure said second frame to said fixed frame.

* * * * *